US008123493B2

(12) United States Patent
Yoshimura et al.

(10) Patent No.: US 8,123,493 B2
(45) Date of Patent: Feb. 28, 2012

(54) SCREW COMPRESSOR

(75) Inventors: Shoji Yoshimura, Takasago (JP); Toru Noguchi, Kako-gun (JP)

(73) Assignee: Kobe Steel, Ltd., Kobe-shi (JP)

( * ) Notice: Subject to any disclaimer, the term of this patent is extended or adjusted under 35 U.S.C. 154(b) by 532 days.

(21) Appl. No.: 12/328,174

(22) Filed: Dec. 4, 2008

(65) Prior Publication Data

US 2009/0191082 A1 Jul. 30, 2009

(30) Foreign Application Priority Data

Jan. 24, 2008 (JP) ..... 2008-013870
Mar. 31, 2008 (JP) ..... 2008-089889

(51) Int. Cl.
*F04B 39/04* (2006.01)
*F04B 39/06* (2006.01)

(52) U.S. Cl. ..... 417/228; 418/84; 418/98; 418/201.1; 184/6.16

(58) Field of Classification Search ..... 417/410.4, 417/228, 310; 418/84, 88, 98, 201.1, 206.3, 418/206.7–206.8; 184/6.16, 103.1–103.2
See application file for complete search history.

(56) References Cited

U.S. PATENT DOCUMENTS 3,876,037 A * 4/1975 Rath, Jr. ..... 184/6.4
4,173,440 A * 11/1979 Libis ..... 418/84
4,394,113 A * 7/1983 Bammert ..... 418/98
4,632,650 A 12/1986 Frieden et al.
4,758,136 A * 7/1988 Pamlin et al. ..... 418/15
4,983,106 A * 1/1991 Wright et al. ..... 418/2
5,028,220 A * 7/1991 Holdsworth ..... 418/2
5,080,195 A * 1/1992 Mizumoto et al. ..... 184/6.4
5,082,427 A * 1/1992 Fujiwara et al. ..... 417/292
5,318,151 A * 6/1994 Hood et al. ..... 184/6.1
5,626,470 A * 5/1997 Gerhardt ..... 418/84
5,642,989 A * 7/1997 Keddie ..... 417/298
5,761,914 A * 6/1998 Carey et al. ..... 62/84
5,820,352 A * 10/1998 Gunn et al. ..... 417/53
(Continued)

FOREIGN PATENT DOCUMENTS

EP 1 366 297 B1 12/2003
(Continued)

OTHER PUBLICATIONS

Office Action issued Aug. 20, 2010, in Chinese Patent Application No. 200910009947.8 filed Jan. 24, 2009 (with English translation).

(Continued)

*Primary Examiner* — Devon C Kramer
*Assistant Examiner* — Joseph Herrmann
(74) *Attorney, Agent, or Firm* — Oblon, Spivak, McClelland, Maier & Neustadt, L.L.P.

(57) ABSTRACT

A screw compressor is disclosed wherein a pair of rotor shafts are disposed horizontally and an oil sump is formed at the bottom of a bearing casing which accommodates bearings for supporting the rotor shafts, a bearing lower portion being soaked into oil present in the oil sump for lubrication. The screw compressor comprises a chamber provided separately from the bearing casing, an oil line for communication between the oil sump in the bearing casing and the chamber and oil level detecting means disposed in the chamber. According to this structure, the oil level in the bearing casing can be checked accurately and there is no fear of oil shortage in the bearings.

6 Claims, 2 Drawing Sheets

U.S. PATENT DOCUMENTS

| | | | | |
|---|---|---|---|---|
| 6,182,467 | B1 | 2/2001 | Zhong et al. | |
| 6,722,858 | B2 * | 4/2004 | Yoshimura et al. | 417/313 |
| 7,140,779 | B2 * | 11/2006 | Yoshimura et al. | 384/306 |
| 7,165,949 | B2 * | 1/2007 | Firnhaber | 417/228 |
| 2003/0223885 | A1 * | 12/2003 | Nakamura et al. | 417/228 |
| 2010/0233004 | A1 * | 9/2010 | Matsuzaka et al. | 418/84 |

FOREIGN PATENT DOCUMENTS

| | | |
|---|---|---|
| JP | 57-102595 | 6/1982 |
| JP | 2-153293 | 6/1990 |
| JP | 5-172074 | 7/1993 |
| JP | 2580020 | 11/1996 |
| JP | 10-318164 | 12/1998 |
| JP | 2003-148370 | 5/2003 |
| JP | 2005-337242 | 12/2005 |
| KR | 10-0611271 | 8/2006 |

OTHER PUBLICATIONS

Korean Office Action issued on Jan. 11, 2011, in the corresponding Korean Patent Application No. 10-2008-135233 (with English Translation).

* cited by examiner

SCREW COMPRESSOR

BACKGROUND OF THE INVENTION

1. Field of the Invention

The present invention relates to a screw compressor.

2. Description of the Related Art

In a conventional screw compressor having a pair of male and female screw rotors with rotor shafts disposed in the horizontal direction, a timing gear and bearings are mounted on each of the rotor shafts and are lubricated and cooled with oil to prevent damage thereof.

In connection with the related art, an oil bath method is mentioned as a general lubricating method used in case of low- or medium-speed rotation. In the oil bath method it is desirable to install an oil gauge and thereby make it possible to check the oil level easily so that the oil level lies at the center of a bottom roller in principle. However, when it is intended to adopt the oil bath method for lubrication of bearings and timing gears in a positive-displacement compressors such as, for example, a screw compressor, it may not always be possible to install an oil gauge at such a position as permits easy visual checking of the oil level due to, for example, a unique external shape of a bearing casing for accommodating the bearings and timing gears.

In Japanese Patent No. 2580020, compressed air is taken out from a casing of an air compressor and is conducted to a throttle portion of an oil mist producer, then with a negative pressure generated in the throttle portion, lubricating oil is sucked up and made into oil mist, then oil mist is fed for lubrication to bearings and timing gears accommodated within a casing. According to this conventional method it is possible to avoid exhaustion of the lubricating oil, but there remains the problem that the position of oil level cannot be confirmed.

In Japanese Patent Laid-Open No. 2003-148370, an oil level sensor is mounted within a casing of a scroll compressor, and when the oil level becomes lower than the position of the oil level sensor, a valve opens in accordance with a signal provided from the oil level sensor, and lubricating oil is supplied from an oil container which stores the lubricating oil. In the scroll compressor, however, rotor shafts are disposed in the vertical direction, and if the lubricating method is applied to a screw compressor with rotor shafts disposed in the horizontal direction, the oil level varies greatly due to splash of oil by timing gears and it is difficult to effect an accurate oil level detection.

SUMMARY OF THE INVENTION

It is an object of the present invention to provide a screw compressor having rotor shafts disposed horizontally and bearings for supporting the rotor shafts, the bearings being lubricated by an oil bath method, the screw compressor permitting accurate confirmation of the level of oil present within a bearing casing and being not likely to cause oil shortage in the bearings.

According to the present invention, as means for achieving the above-mentioned object, there is provided a screw compressor comprising a pair of rotor shafts disposed horizontally; bearings for supporting the rotor shafts; a bearing casing for accommodating the bearings; an oil sump formed in a bottom of the bearing casing, the oil sump being structured so as to allow a lower portion of the bearings to be soaked into oil for lubrication; a chamber provided separately from the bearing casing; an oil line for communication between the oil sump and the chamber; and oil level detecting means disposed in the chamber.

When rotors are rotating in the screw compressor, oil level detecting means disposed in the interior of the screw compressor cannot be utilized because the oil level at the bottom of the bearing casing is oscillating due to splash of oil. However, according to the aforesaid means, since there is provided an oil line for communication between the bearing casing and the chamber separate from the bearing casing, the oil level can be detected accurately with the oil level detecting means disposed in the chamber which is provided separately from the bearing casing in the compressor, without being influenced by variations in oil level in the interior of the compressor.

Preferably, there is provided a communication line for communication between a space positioned above an oil level in the chamber and a space positioned above an oil level in the bearing casing. With this structure, the oil level can be detected accurately with the oil level detecting means disposed in the chamber which is provided separately from the bearing casing in the compressor, without being influenced by variations in oil level in the interior of the compressor.

Preferably, a pair of timing gears are accommodated within the bearing casing, the timing gears being mounted on one ends of the rotor shafts and meshing with each other, and the position of connection between the oil sump formed in the bearing casing with the timing gears accommodated therein and the oil line corresponds to a lower-limit height of oil level of the oil sump permitting lubrication of the bearings. With this structure, lubrication can be done while allowing a timing gear lower portion to be soaked into oil.

Preferably, there is provided an oil supply line for the supply of oil to the bearing casing, and when the oil level detecting means detects as a value of the oil level in the chamber a value lower than a preset first value indicative of a lower limit, oil is fed into the bearing casing through the oil supply line. With this structure, the oil level can be detected by the oil level detecting means disposed in the chamber separate from the bearing casing without being influenced by variations in oil level in the interior of the casing and it is possible to replenish a required amount of oil into the casing through the chamber and the oil supply line.

Preferably, there is provided an oil discharge line for the discharge of oil from the bearing casing, and when the oil level detecting means detects as a value of the oil level in the chamber a value higher than a preset second value indicative of an upper limit, oil is discharged from the bearing casing through the oil discharge line. With this structure, the oil level can be detected by the oil level detecting means disposed in the chamber separate from the bearing casing without being influenced by variations in oil level in the interior of the casing and it is possible to discharge a required amount of oil from the interior of the casing.

Preferably, there are provided an oil supply line for the supply of oil to the bearing casing, an oil discharge line for the discharge of oil from the bearing casing, and oil temperature detecting means disposed in the oil line, and when the oil level detecting means detects as a value of the oil level in the chamber a value lower than a preset first value indicative of a lower limit, oil is fed into the bearing casing through the oil supply line, while when the oil level detecting means detects as a value of the oil level in the chamber a value higher than a preset second value indicative of an upper limit, oil is discharged from the bearing casing through the oil discharge line, further, when the oil level detecting means detects as a value of the oil level in the chamber a value higher than a preset third value lying between the first value and the second value and when the oil temperature detecting means detects as a value of the oil temperature a value higher than a preset value, the oil is discharged from the bearing casing through the oil discharge line. With this structure, by further providing oil temperature detecting means in the oil supply line, it is possible to discharge oil on the basis of the value of oil level and that of oil temperature.

According to the present invention, when rotors disposed horizontally of the screw compressor are rotating, the oil level detecting means disposed in the interior of the compressor cannot be utilized because the oil level at the bottom of the bearing casing is oscillating, but since there are provided a chamber separate from the bearing casing in the compressor, as well as an oil line and a communication line both for communication between the bearing casing and the chamber, the level of oil present in the interior of the compressor can be detected and checked accurately by the oil level detecting means detecting the oil level in the chamber separate from the bearing casing in the compressor without being influenced by variations in oil level in the interior of the compressor. Consequently, it is possible to avoid the occurrence of oil shortage in the bearings.

Besides, since oil is replenished in combination with oil level control, it is possible to prevent damage of the bearings caused by lowering of the oil level.

The chamber separate from the compressor can be of a simple structure serving as both a structure for detecting the oil level in the oil sump formed in the bearing casing and a structure for the supply of oil.

If the amount of oil present in the interior of the compressor becomes too large, the oil temperature rises as a result of agitation of the oil and it is possible that there may occur damage of the bearings due to lowering of viscosity. However, such a possibility can be eliminated by making control based on the value of oil level and that of oil temperature.

DESCRIPTION OF THE PREFERRED EMBODIMENT

An embodiment of the present invention will be described below with reference to the accompanying drawings.

Figure 1:
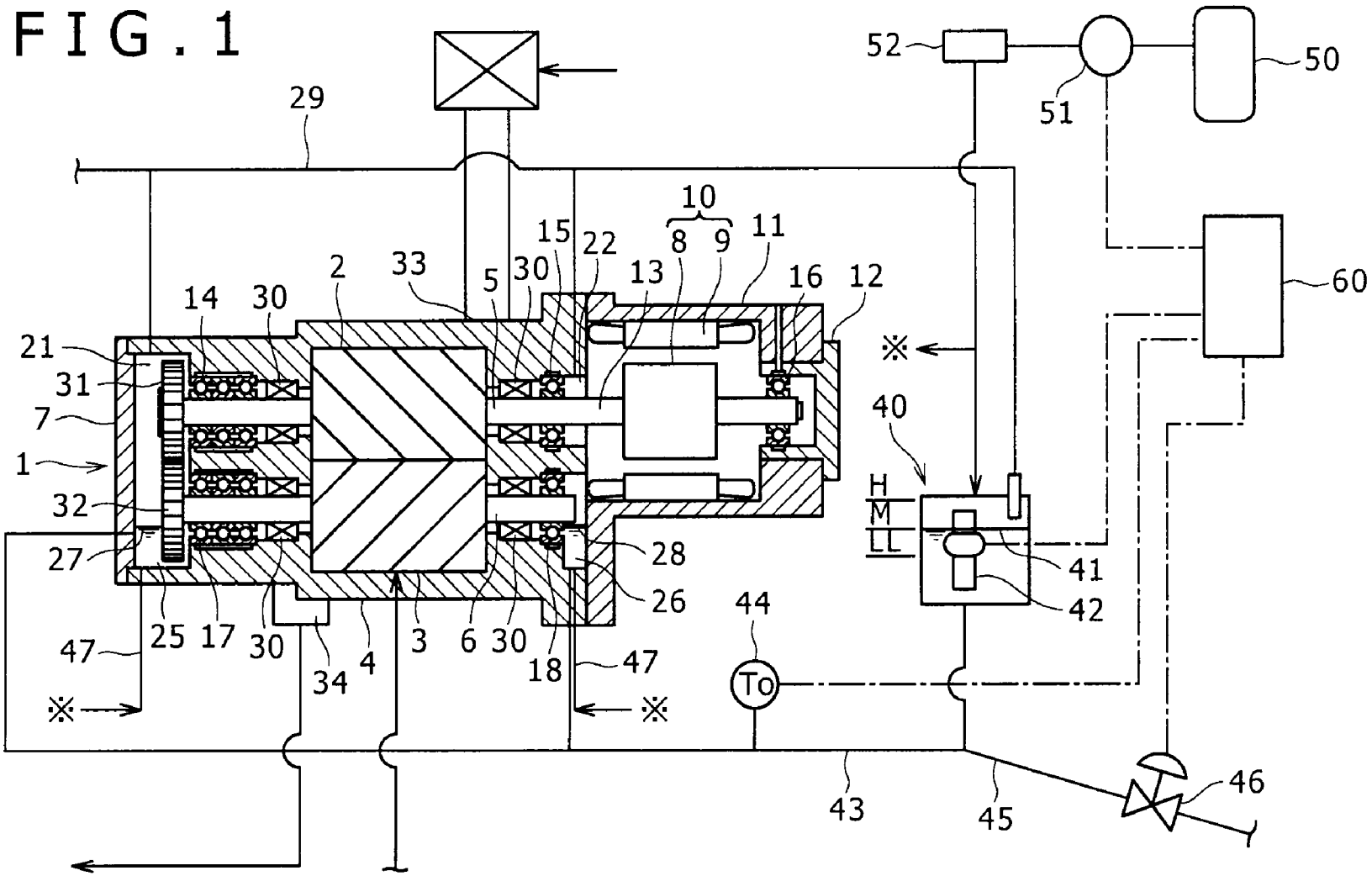
FIG. 1 is a schematic diagram (partially in section) of a screw compressor according to an embodiment of the present invention.

FIG. 1 illustrates a screw compressor 1 according to an embodiment of the present invention. The screw compressor 1 is an oil lubrication type screw compressor wherein screw rotors 2 and 3 are cooled and lubricated with oil. In the screw compressor 1, a pair of male rotor 2 and female rotor 3 meshing with each other are accommodated within a rotor casing 4. Rotor shafts 5 and 6 of the rotors 2 and 3 are disposed horizontally. One end of the rotor casing 4 is closed with a cover 7, while to an opposite end of the rotor casing 4 is mounted a motor casing 11 which accommodates a motor 10 composed of a rotor 8 and a stator 9. An end portion of the motor casing 11 is also closed with a cover 12. The rotor shaft 5 of the male rotor 2 and a motor shaft 13 of the motor 10 share an integrally-formed shaft (separate rotor shaft 5 and motor shaft 13 may be coupled together using a coupling (not shown) or the like). A screw rotor-side end portion of the rotor shaft 5 is supported by the rotor casing 4 through a rotor-side rolling bearing 14, an intermediate portion of the rotor shaft 5 located between the male rotor 2 and the motor 10 is supported by the rotor casing 4 through an intermediate rolling bearing 15, and a motor-side end portion of the rotor shaft 5 is supported by the motor casing 11 through a motor-side rolling bearing 16. Both ends of the rotor shaft 6 of the female rotor 3 are supported by the rotor casing 4 through rolling bearings 17 and 18. The rotor casing 4 has a discharge-side bearing casing 21 for accommodating the bearings 14 and 17 and a suction-side bearing casing 22 for accommodating the bearings 15 and 18. Oil sumps 25 and 26 are formed in the bearing casings 21 and 22, respectively, to lubricate the bearings 14, 15, 17 and 18 in accordance with an oil bath method (or an oil bath splash lubrication method).

Spaces positioned above oil levels 27 and 28 in the suction-side bearing casing 22 and the discharge-side bearing casing 21 are in communication with each other through a communication line 29 and further communicate with the atmosphere. Lip seals 30 are provided on the rotor shafts 5 and 6 for partitioning between the interior and the exterior of the rotor casing (a compressing space) in which the rotors 2 and 3 are accommodated. Timing gears 31 and 32 are fixed to an end of the male rotor 2 and an end of the female rotor 3, respectively, so as to mesh with each other. An air suction port 33 and an air discharge port 34 are formed in the rotor casing 4.

A chamber 40 is provided in the exterior of the screw compressor 1 separately from the suction-side bearing casing 22 and the discharge-side bearing casing 21. Oil is poured into the chamber 40 as will be described later. A space positioned above an oil level 41 in the chamber 40 is in communication through the communication line 29 with the spaces positioned above the oil levels 27 and 28 in the compressor bearing casings 21 and 22. The communication line 29 is also in communication with the atmosphere. The space in the chamber 40 may be opened to the atmosphere without communication with the communication line 29. An oil level sensor (oil level detecting means) 42 is provided in the chamber 40.

Figure 2:
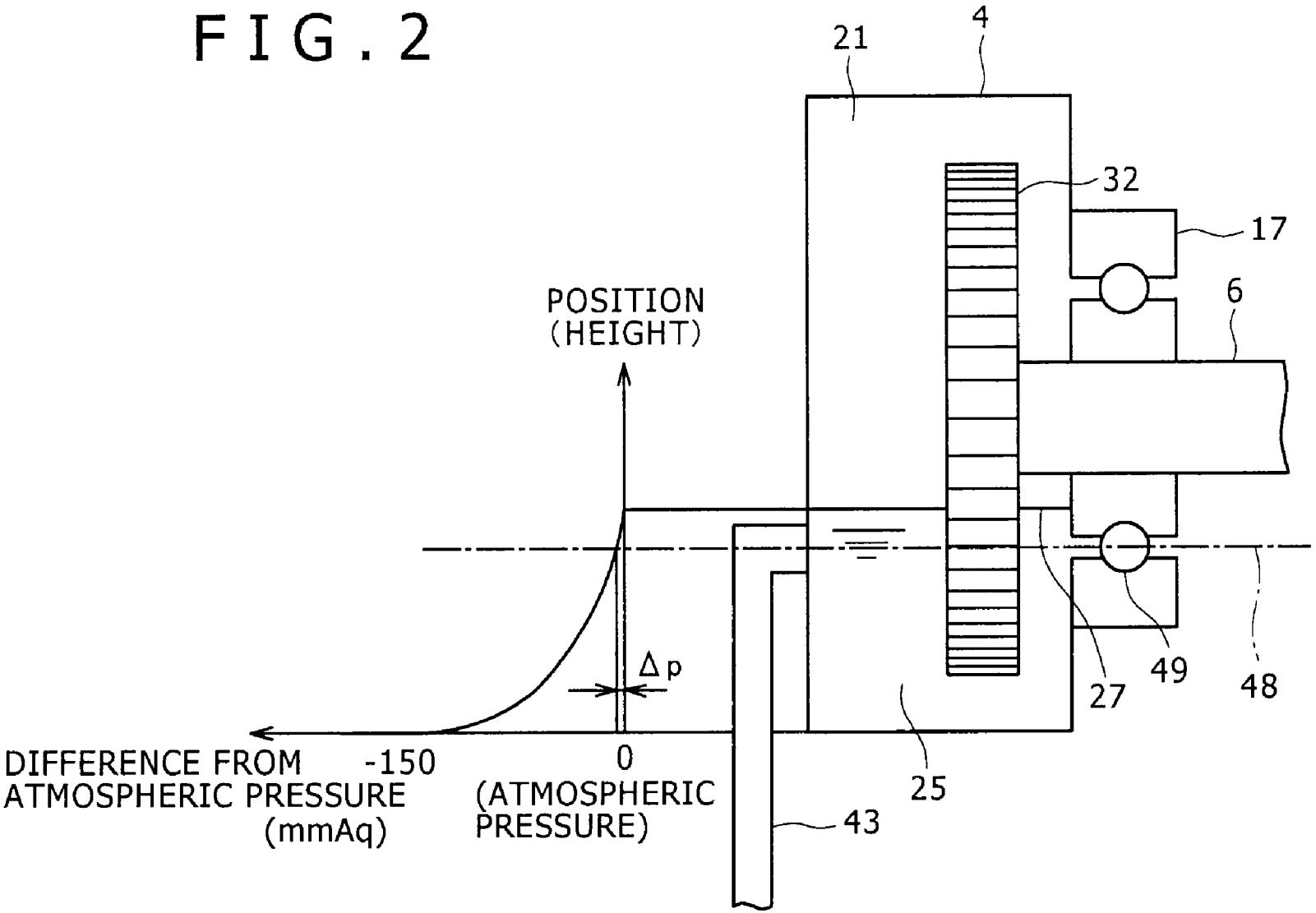
FIG. 2 shows differences from the atmospheric pressure at various positions (heights) from the bottom of a discharge-side bearing casing during operation of the compressor in the case where an oil line and an oil sump formed in the bearing casing which accommodates timing gears are connected with each other at the height of a trip oil level.

The bottoms (oil sumps) 25 and 26 of the suction-side bearing casing 22 and the discharge-side bearing casing 21 in the screw compressor 1 and the bottom of the chamber 40 are in communication with each other through an oil line 43. The oil sump 25 in the bearing casing 21 in which the timing gears 31 and 32 are accommodated and the oil line 43 are connected with each other at the height of a lower limit (here designated a trip oil level 48) of the oil level 27 in the oil sump 25 which permits lubrication of the bearings 14 and 17 as shown in FIG. 2. According to an experiential knowledge, this oil level lower limit (i.e., the trip oil level) is usually set to a position which passes approximately the center of a lower roller 49 (see FIG. 2) of the bearing 17. Although the oil line 43 also serves as an oil supply line, an oil supply line 47 separate from the oil line 43 may be connected to the bearing casings 21 and 22. An oil temperature sensor 44 capable of detecting the temperature of the oil temperature To is provided in the oil line 43.

An oil discharge line 45 branches from the oil line 43 and an opening/closing valve 46 for the discharge of oil is provided in the oil discharge line 45.

Oil is fed from an oil tank 50 for storing oil, to the chamber 40 through an oil pump 51 and an oil cooler 52.

In the oil lubrication type screw compressor 1 there is provided a control unit 60 which controls the oil pump 51 and the opening/closing valve 46 for the discharge of oil in accordance with detection signals provided from the oil level sensor 42 and the temperature sensor 44.

In the screw compressor 1 structured as above, upon turning ON of the motor 10, the male rotor 2 rotates via the rotor shaft 5, and further the female rotor 3 rotates via the timing gears 31 and 32. With rotation of the male and female rotors 2, 3, the air which has been sucked from the suction port 33 into the rotor casing (compressing space) with the rotors 2 and 3 accommodated therein is compressed and discharged from the discharge port 34.

Since the bottom of the chamber 40 and the bottoms (oil sumps) 25, 26 of the suction-side bearing casing 22 and the discharge-side bearing casing 21 are in communication with each other through the oil line 43, and the oil level 41 in the chamber 40 and the oil levels 27, 28 in the bearing casings 21, 22 are subjected to the same pressure through the communication line 29, the oil levels 27, 28 and 41 are at the same height in accordance with Pascal's principle. Actually, however, it has been known that in the case where the oil sump 25 in the discharge-side bearing casing 21 and the oil line 43 are connected with each other at the bottom, there occurs a discrepancy in height among the oil levels 27, 28 and 41, if the oil is agitated with the timing gears 31 and 32.

According to an experimental result obtained in a proof test (using a screw compressor 1 according to the present invention not provided with the oil line 43) conducted by the present inventors, under the operating conditions of 5000 rpm, 70° C., or 1000 rpm, 4° C., the pressure near the bottom of the discharge-side bearing casing 21, especially the pressure near the bottom and on the side more distant from the screw rotors 2 and 3 in the discharge-side bearing casing 21, was found to be a negative pressure of about −150 mmAq in comparison with the atmospheric pressure.

Judging from this experimental result, oil moves from the chamber 40 toward the discharge-side bearing casing 21 through the oil line 43 during operation due to a pressure difference developed between the chamber 40 held at the atmospheric pressure and the vicinity of the bottom of the discharge-side bearing casing 21 locally held at a negative pressure, with the result that a difference occurs between the height of the oil level 41 in the chamber 40 and that of the oil level 27 in the discharge-side bearing casing 21. The differences in height among the oil levels 27, 28 and 41 vary depending on various conditions (e.g., the viscosity of oil and the number of revolutions of the timing gears 31 and 32).

On the other hand, in the proof test conducted by the present inventors, it was confirmed that if the position of connection between the oil sump 25 in the bearing casing 21 with the timing gears 31 and 32 accommodated therein and the oil line 43 was made equal to the height of the trip oil level 48, there occurred little difference between the height of the oil level 41 in the chamber 40 and that of the oil level 27 in the discharge-side bearing casing 21 in a state in which the oil levels 27, 28 and 41 approached the trip oil level 48. This is presumed to be for the following reason. The oil sump 25 in the bearing casing 21 is agitated with rotation of the timing gears 31 and 32, resulting in generation of a negative pressure. Consequently, there occurs movement of oil from the chamber 40 to the discharge-side bearing casing 21 through the line 43, so that there occurs a difference in height between the oil level 41 in the chamber 40 and the oil level 27 in the discharge-side bearing casing 21. However, the closer the position of connection to the bottom of the discharge-side bearing casing 21, the greater the influence of the negative pressure and the larger the amount of oil moving to the discharge-side bearing casing 21 and hence the more significant the difference in the height of oil level. Conversely, the closer the position of connection to the trip oil level, the smaller the influence of the negative pressure and the smaller the amount of oil moving to the discharge-side bearing casing 21 and hence the less significant the height of oil level.

FIG. 2 shows differences from the atmospheric pressure at various positions (heights) from the bottom of the discharge-side bearing casing 21 during operation of the screw compressor. The difference between the pressure at the height of the trip oil level 48 and the atmospheric pressure is $\Delta p$. However, the value of $\Delta p$ is a very small value and the difference between the height of the oil level 41 in the chamber 40 and that of the oil level 27 in the discharge-side bearing casing 21 is of a substantially ignorable degree.

As noted above, if the oil sump 25 in the bearing casing 21 in which the timing gears 31 and 32 are accommodated and the oil line 43 are connected with each other at the height of the trip oil level 48, it is possible to check positively whether the oil level 27 has reached the height of the trip oil level 48 while avoiding the occurrence of a difference in height between the oil levels 27 and 41. By maintaining the height of the oil level 27 in the discharge-side bearing casing 21 so as not to become lower than the trip oil level 48, the bearings 14, 15, 17 and 18 can be prevented from undergoing oil shortage.

Next, a description will be given about the supply and discharge of oil which are controlled by the control unit 60. When the oil level sensor 42 in the chamber 40 detects that the oil level 41 has become lower than a preset first value "height LL" of lower limit, the oil pump 51 is activated by the control unit 60 and cooled oil is fed to the chamber 40 (and hence to the bearing casings 21 and 22) through the oil cooler 52 from the oil tank 50. Upon lapse of a predetermined time after activation of the oil pump 51 or when the oil level 41 reaches a preset third value "height M" (higher than the first value "height LL" and lower than a second value "height H" to be described later), the oil pump 51 is turned OFF. As the oil level 41 in the chamber 40 is raised, the oil levels 27 and 28 in the oil sumps 25 and 26 also rise interlockedly to the same height as the oil level 41 in accordance with Pascal's principle. As a result of the rise of the oil level 41 in the chamber 40, oil is fed to the bearing casings 21 and 22 and thus damage of the bearings 14, 15, 17 and 18 caused by lowering of the oil levels in those bearing casings can be prevented. It suffices for the "height LL" to be set to a value equal to or higher than the trip oil level 48.

When the oil level 41 becomes higher than a preset second value "height H" which indicates an upper limit, the opening/closing valve 46 for the discharge of oil is opened, and oil is discharged from the bearing casings 21 and 22, then upon lapse of a predetermined time after opening of the valve 46 or when the oil level 41 reaches the third value "height M," the valve 46 is closed to terminate the discharge of oil from the bearing casings 21 and 22. If too much oil is supplied, the amount of oil agitated by the bearings 14, 15, 17, 18 and the timing gears 31, 32 increases, resulting in increase of the oil temperature and lowering of viscosity, whereby there is a possibility of damage of the bearings 14, 15, 17 and 18. However, such a possibility can be eliminated (excessive supply of oil can be prevented) by the structure described above.

Even if the oil level 41 is not higher than the preset second value "height H" indicative of an upper limit, if it is higher than the third value "height M" and the oil temperature To is higher than a preset upper-limit temperature, the opening/closing valve 46 for the discharge of oil may be opened and oil may be discharged from the bearing casings 21 and 22. In this connection, there may be adopted a structure wherein when a predetermined time has elapsed after opening of the opening/ closing valve 46, or when the oil level 41 has reached a preset "height L" (lower than the third value "height M" and higher than the first value "height LL"), or when the oil temperature To drops to a preset temperature (a temperature lower than the above upper-limit temperature), the opening/closing valve 46 is closed to terminate the discharge of oil from the bearing casings 21 and 22. Even with this structure, it is possible to eliminate the possibility of damage of the bearings 14, 15, 17 and 18 because of a rise of the oil temperature To and the resultant lowering of viscosity. Even if the oil temperature To is higher than the upper-limit temperature, if the oil level is lower than the "height M," priority is given to ensuring the required amount of oil and the discharge of oil is not performed as described above.

Since the structure adopted in the above embodiment wherein the oil stored in the oil tank 50 is fed to the chamber 40 with the oil pump 51 combines the structure for detecting the oil levels 27 and 28 in the oil sumps 25 and 26 formed in the bearing casings 21 and 22 with the structure for the supply of oil to the bearing casings 21 and 22, there also accrues a merit that the structure becomes simpler.

The above description is merely illustrative of the technical concept of the present invention, and technical concept of the present invention is not limited by the above embodiment. Modifications and changes may be made within the scope of the present invention. For example, the space which overlies the oil level 41 in the chamber 40 communicates through the communication line 29 with the space which overlies the oil levels 27 and 28 in the compressor bearing casings 21 and 22, and it need not always be open to the atmosphere.

Further, the space which overlies the oil level 41 in the chamber 40 communicates through the communication line 29 with the space which overlies the oil levels 27 and 28 in the compressor bearing casings 21 and 22, and it may be structured so as to permit the injection of inert gas through the communication line 29.

What is claimed is:

1. A screw compressor comprising:

a pair of rotor shafts disposed horizontally;

bearings for supporting said rotor shafts;

a bearing casing for accommodating said bearings;

an oil sump formed in a bottom of said bearing casing, said oil sump being structured so as to allow a lower portion of said bearings to be soaked into oil for lubrication, wherein a pair of timing gears are mounted on one ends of said rotor shafts and accommodated within said bearing casing, said timing gears meshing with each other;

an oil chamber provided separately from said bearing casing;

an oil line connected between said oil sump and said oil chamber, wherein a height position of a connection of said oil line to said oil sump corresponds to a lower-limit height of an oil level in said oil sump for permitting lubrication of said bearings; and oil level detector disposed in said oil chamber.

2. The screw compressor according to claim 1, further comprising a communication line for communication between a space positioned above an oil level in said oil chamber and a space positioned above an oil level in said bearing casing.

3. The screw compressor according to claim 1, further comprising an oil supply line for the supply of oil to said bearing casing, wherein when said oil level detector detects as a value of the oil level in said oil chamber a value lower than a preset first value indicative of a lower limit, oil is fed into said bearing casing through said oil supply line.

4. The screw compressor according to claim 1, further comprising an oil discharge line for the discharge of oil from said bearing casing, wherein when said oil level detector detects as a value of the oil level in said chamber a value higher than a preset second value indicative of an upper limit, oil is discharged from said bearing casing through said oil discharge line.

5. The screw compressor according to claim 1, further comprising:

an oil supply line for the supply of oil to said bearing casing;

an oil discharge line for the discharge of oil from said bearing casing; and oil temperature detector disposed in said oil line, wherein:

when said oil level detector detects as a value of the oil level in said oil chamber a value lower than a preset first value indicative of a lower limit, oil is fed into said bearing casing through said oil supply line, while when said oil level detector detects as a value of the oil level in said oil chamber a value higher than a preset second value indicative of an upper limit, oil is discharged from said bearing casing through said oil discharge line, further, when said oil level detector detects as a value of the oil level in said oil chamber a value higher than a preset third value lying between said first value and said second value and when said oil temperature detector detects as a value of the oil temperature a value higher than a preset value, the oil is discharged from said bearing casing through said oil discharge line.

6. The screw compressor according to claim 1, wherein the lower limit height of the oil level in said oil sump for permitting lubrication of said bearings is approximately a height of a center of the lowermost bearing element.

* * * * *